US007825595B2

(12) United States Patent
Bochkov

(10) Patent No.: US 7,825,595 B2
(45) Date of Patent: Nov. 2, 2010

(54) CONTROLLABLE GAS-DISCHARGE DEVICE

(76) Inventor: Viktor Dmitrievich Bochkov, ul. Gorkogo, 37/1-2, Ryazan (RU) 090000

( * ) Notice: Subject to any disclaimer, the term of this patent is extended or adjusted under 35 U.S.C. 154(b) by 506 days.

(21) Appl. No.: 11/921,431

(22) PCT Filed: Jun. 2, 2005

(86) PCT No.: PCT/RU2005/000298

§ 371 (c)(1),
(2), (4) Date: Nov. 29, 2007

(87) PCT Pub. No.: WO2006/130036

PCT Pub. Date: Dec. 7, 2006

(65) Prior Publication Data

US 2009/0121629 A1 May 14, 2009

(51) Int. Cl.
*H01J 17/04* (2006.01)

(52) U.S. Cl. ..... 313/581

(58) Field of Classification Search ..... 313/581, 313/601–603, 231.01; 315/111.01, 335; 361/120, 130

See application file for complete search history.

(56) References Cited

U.S. PATENT DOCUMENTS 5,057,740 A * 10/1991 Kirkman-Amemiya ..... 313/542
5,146,141 A * 9/1992 Rohde ..... 315/326
7,579,578 B2 * 8/2009 Deaconu ..... 250/214 LS

FOREIGN PATENT DOCUMENTS

RU 2089003 C1 * 8/1997
RU 2243612 C1 * 12/2004

OTHER PUBLICATIONS

Bochkov et al., "The Pseudospark Switch Crowbar Unit—High Reliability, Low Cost System", 12th IEEE International Pulsed Power Conference, Monterey, CA, USA, Jun. 27-Jun. 30, 1999, pp. 1272-1274.*

Iberler et al., "Fundamental Investigation in Two Flashover-Based Trigger Methods for Low-Pressure Gas Discharge Switches", IEEE Trans. Plasma Science, vol. 32, No. 1, pp. 208-213, 2004.*

* cited by examiner

*Primary Examiner*—Nimeshkumar D Patel
*Assistant Examiner*—Peter R Haderlein
(74) *Attorney, Agent, or Firm*—Donn K. Harms

(57) ABSTRACT

The invention relates to controllable powerful cold-cathode gas-discharge devices or pseudospark switches intended for rapidly switching high-current high-voltage circuits, which can be used in different pulse devices. The inventive cold-cathode gas-discharge device comprises an anode, a hollow cathode which is separated therefrom by a main discharge gap and whose base is oriented thereto, wherein said base is provided with openings embodied therein for coupling the main discharge gap to a trigger electrode which is arranged in the cathode cavity and is provided with an igniter made of a polycrystal semiconductor material based on a semiconductor whose energy gap is larger than 1.5 eV, the device comprises at least two contacting electrodes contacting with the igniter, wherein at least one electrode is connected to the trigger electrode, whereas the other is insulated therefrom and connected to the cathode, the maximum width of the contacting electrode in the cross-section thereof across a point where it is brought into contact with the igniter is equal to or less than 100 times the average pitch of roughness value on the igniter surface.

9 Claims, 3 Drawing Sheets

CONTROLLABLE GAS-DISCHARGE DEVICE

FIELD OF THE INVENTION

The present invention relates to electronics, namely to controllable powerful gas-discharge devices, and more particularly to thyratrons with non-heated cathode or "pseudospark switches", intended for fast switching in high-current high-voltage circuits of various pulse apparatuses.

BACKGROUND OF THE INVENTION

The basic elements of the controllable switching device are an electrode system, comprising a working discharge gap, high-voltage insulators and a trigger assembly. The trigger assembly is the most critical element of the device and it basically affects the service time, reliability and timing characteristics of the switch. Triggering of the switch can be accomplished by various means, including triggering from hot cathode and by laser shot, however prevailing methods are the triggering with a discharge over a dielectric surface, a discharge on a semiconductor element and a triggering mechanism based on an auxiliary glow discharge.

When operated the switch is required to have extremely fast rise of current in an anode circuit with low and stable time delay when triggering pulse with minimum energy is applied to the a trigger assembly, as well as a sufficiently broad range of operating gas pressure in the switch, ensuring long-term operation of the switch under conditions of gas absorption in the discharge and change of electrodes temperature. The parameters significantly depend on triggering mechanism and configuration of trigger assembly—starting electrode.

For the switch to operate normally it is required that the trigger part provides stable and low (less than 1 μs) delay time and, secondly, the operational life is remarkably longer than the service life of the basic electrodes of the device.

One such switch—a controllable gas-discharge device (pseudospark switch), taught by application EUP N 0433480, cl. H01T 2/02, pub. 26.06.91 as well as US patent "Gas-electronic switch (pseudospark switch)" U.S. Pat. No. 5,091,819, Feb. 25, 1992, issued to J. Christiansen et al., discloses a thyratron, comprising an anode and a cathode with central holes, connecting cavities in the electrodes with main gap and trigger electrode. The trigger electrode with adjacent cathode serves as a unit triggering main discharge between electrodes of the switch. Triggering of the main gap is exercised by plasma injection from the trigger electrode under firing potential through the holes in the cathode.

The known design suffers from a limited range of working gas pressure, has complicated triggering circuit configuration and low dielectric strength, which is conditioned by a presence of charged particles close to the cathode hole, generated in an auxiliary discharge, as well as high temporal instabilities (pulse edge instability, time jitter), high pulse delay time. The design is not effective for switching of energy exceeding 500 J at operating frequencies less than 100-200 Hz.

Another special geometry of pseudospark switch trigger part was investigated by M. Iberler, R. Bischoff, K. Frank, I. Petzenhauser, A. Rainer, J. Urban, "Fundamental Investigation in Two Flashover-Based Trigger Methods for Low-Pressure Gas Discharge Switches", *IEEE Trans. Plasma Sci., vol.* 32, no. 1, p. 208-213, 2004. The geometry has a dielectric ($\in$=2400) disc of 15 mm in diameter and thickness of 0.8 mm. The disc has a one-side metallization to provide reliable contact with metal substrate, whereas from another side it has pectinated contacts with a hollow electrode.

In the beginning of the switch operation a dielectric igniter gives high density of emitting charge, low delay time. However under real conditions due to the fact that in this device the effect of solid dielectric surface breakdown is usually used, with time electrodes materials are sputtered over the dielectric surface, which leads to reducing of emitting charge, whereas timing characteristics of the switch become very unstable and service life is limited by damage of the ignition unit.

In regimes with low operating frequency and high switching charge per shot it is the most advantageous to use semiconductor material in the igniter unit. Having relatively low specific resistance, this material is relatively more stable in terms of the aforesaid characteristics in case of conducting films evaporation in operating switch. Also in this device at the initial stage of discharge development a discharge current passes through the bulk of the igniter, that is why surface properties a lesser degree influence its characteristics within service life. The initiating of breakdown between electrodes contacting the semiconductor does not require high field strength, as it does in case of dielectric, which promotes longer operating capacity of the igniter even in case of substantial electrode erosion.

The close analogy to the presented invention is "Управляемый газоразрядный прибор" (Бочков В.Д., Зайдман С.Ш. и Восьмерик Ю.М. Патент РФ № 1807798, H01 J17/44, Oct. 1, 1990. Опубл. БИ№26 Sep. 20, 1997) {Controlled gas-discharge device, Bochkov V. D., Zaidman S. Sh. and Vosmerick Yu. M., Patent Russian Federation No. 1807798, H01 J17/44, Oct. 1, 1990, published in Bulletin of Inventions №26 Sep. 20, 1997}, comprising an anode and a hollow cathode with plate, facing the anode and having holes, as well as a hollow trigger electrode with a semiconductor igniter, placed in the cathode cavity. Further in the trigger assembly on the semiconductor igniter a contact element is placed, having a plurality of pins, mechanically connected with the igniter surface and galvanically coupled with the trigger electrode.

In the described switch with low buffer gas pressure an ignition device based on semiconductor material with a contact element, connected with a trigger electrode, is used. The contact element in gas-discharge device represents a loop made of a refractory metal wire, wrapped by a copper wire. The wraps of the wire comprise a ribbed surface, comprising a plurality of pins, providing a multidrop contact network.

The above construction have had one or more disadvantages, including the possibility to have only one contact element with a plurality of pins, which reduces life and demands strict compliance of trigger voltage polarity. Another drawback is an insufficient stability of timing parameters as well as relatively high pulse currents required for the switch triggering since even small contact area in case of linear V/A characteristic of the igniter gives too low transient resistance. The need to increase triggering power leads to a growth of power losses on the igniter, reduction of operating temperature range, degradation of frequency and service life of the switch.

DETAILED DESCRIPTION

The aim of the present invention is to create a gas-discharge device with a non-heated cathode, having high hold-off voltage and longevity, reduced trigger energy and low timing uncertainty (delay) of switched current pulses in the whole range of operating voltages, as well as increased operating frequency and high temperature operating range. The present invention must have simple geometry, suitable for repetition work.

This aim can be achieved utilizing a triggered gas-discharge device with non-heated cathode, comprising an anode, a hollow cathode, which is separated therefrom by a main discharge gap and whose base is oriented thereto, wherein said base is provided with openings embodied therein for coupling the main discharge gap to a trigger electrode which is arranged in the cathode cavity and is provided with an igniter made of a polycrystal semiconductor material based on a semiconductor whose energy gap is larger than 1.5 eV, the device comprises at least two contacting electrodes, connected to the igniter, wherein at least one electrode is connected to the trigger electrode, whereas the other is insulated therefrom and connected to the cathode, the maximum width of the contacting electrode in the cross-section thereof across a point where it is brought into contact with the igniter is equal to or less than 100 times the average pitch of roughness value on the igniter surface.

Another distinction is that the igniter is made of polycrystalline material based on a semiconductor with non-linear current-voltage curve, having threshold voltage not greater than 5 kV.

It is yet another distinction that the polycrystalline material of the igniter consists of basic semiconductor material grains, having gaps among them, filled with a semiconductor or a dielectric binding material.

It is the fourth distinction that the distance between the contacting electrodes is 1-5 mm, points of contact with igniter are located on the upper side of the igniter, offering close vision of them in the direction of cathode base, whereas to avoid breakdowns in other directions the igniter is placed into a focusing screen.

It is the fifth distinction that one of the contacting electrodes (CE), namely, the one, connected to the cathode, is disposed in the bulk of the igniter.

It is the sixth distinction that there is a screen, electrically connected to the cathode and eliminating close visibility of the igniter from the anode side through the holes in the cathode base, and the screen is placed into the cathode cavity between cathode base and trigger electrode. It is the seventh distinction that the igniter represents semiconductor compositions made according to ceramic production methods of one or several semiconductor and dielectric powders and having porosity not exceeding 40%.

It is the eighth distinction that the contacting electrodes are connected to the triggering circuit through active and inductive resistive elements.

It is the ninth distinction to use one of the contacting electrodes as a trigger electrode.

PREFERRED EMBODIMENTS OF THE INVENTION

The following embodiments of the invention are represented in enclosed drawings.

The controllable gas-discharge device comprises a housing, made of ceramic high-voltage insulators 1 and containing electrode system—a hollow cathode 2 and an anode 3, separated by main discharge gap with a screen 4, constructed to reduce metallization of insulators 1 by electrode material.

Figure 3:
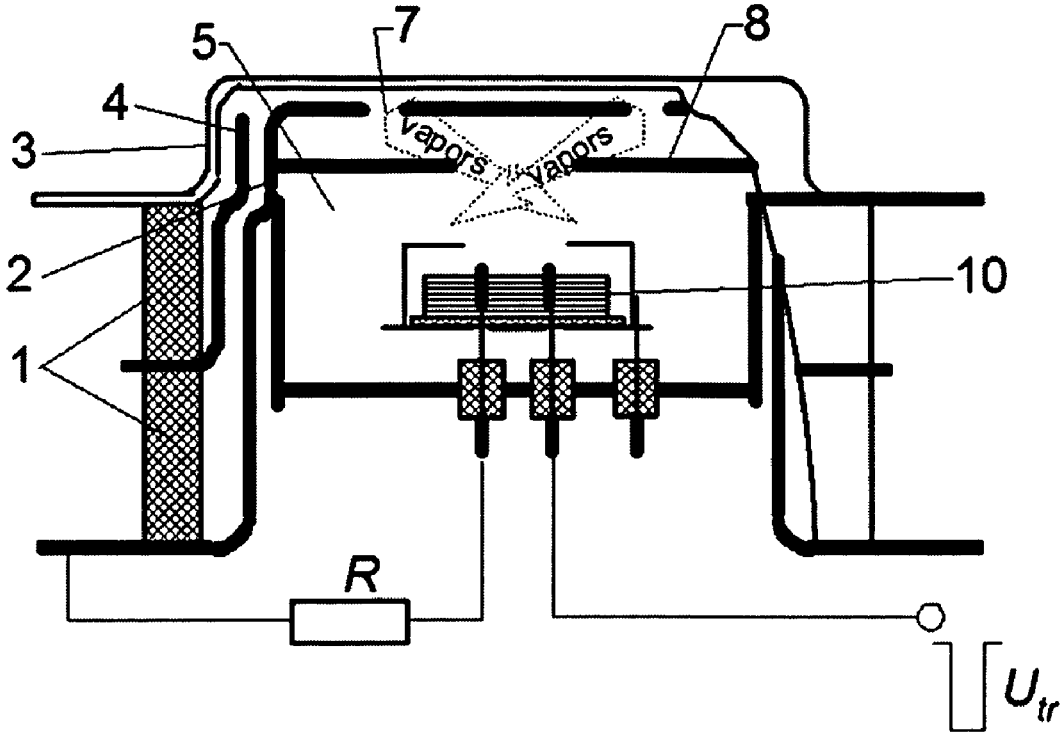
FIG. 3 is a view showing the directions of cathode material evaporation, metallazing the trigger assembly.

Main discharge gap communicates with cathode cavity 5 via holes 7 in the cathode base facing the anode and injection space 6. In the cathode cavity there is a hollow trigger electrode 9 containing an igniter 10. The trigger electrode 9, the igniter 10, the contacting electrodes 11 and 12 and the focusing screen 13 comprise a trigger geometry. As a trigger electrode one of contacting electrodes can be utilized, however in this case the switch timing characteristics, namely, jitter and delay time can be substantially deteriorated. In order to protect the igniter from metallization by electrode materials evaporation from main discharge gap, between cathode base 2 and trigger assembly a special screen 8, blocking off a stream of evaporated metal (FIG. 3) from cathode holes 7 in the direction of electrodes 11, 12 contact points, is placed. Pins 14 and 15 of the contacting electrodes 11 and 12 as well as trigger electrode terminal 16, connected to the focusing screen 13, are connected to external control circuit.

Figure 1:
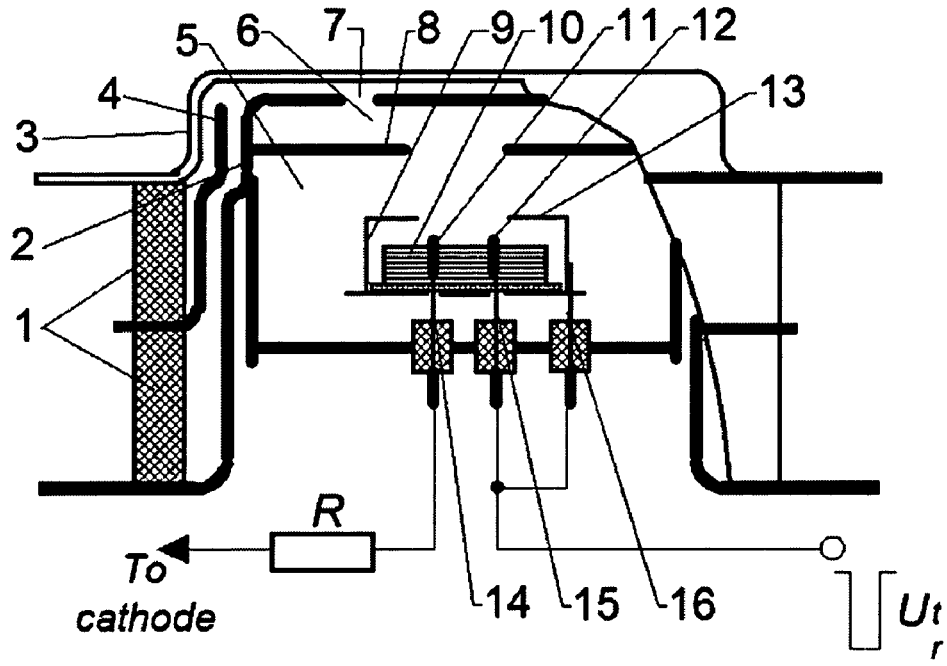
FIG. 1 is a general view of the controllable gas-discharge device.
Figure 2:
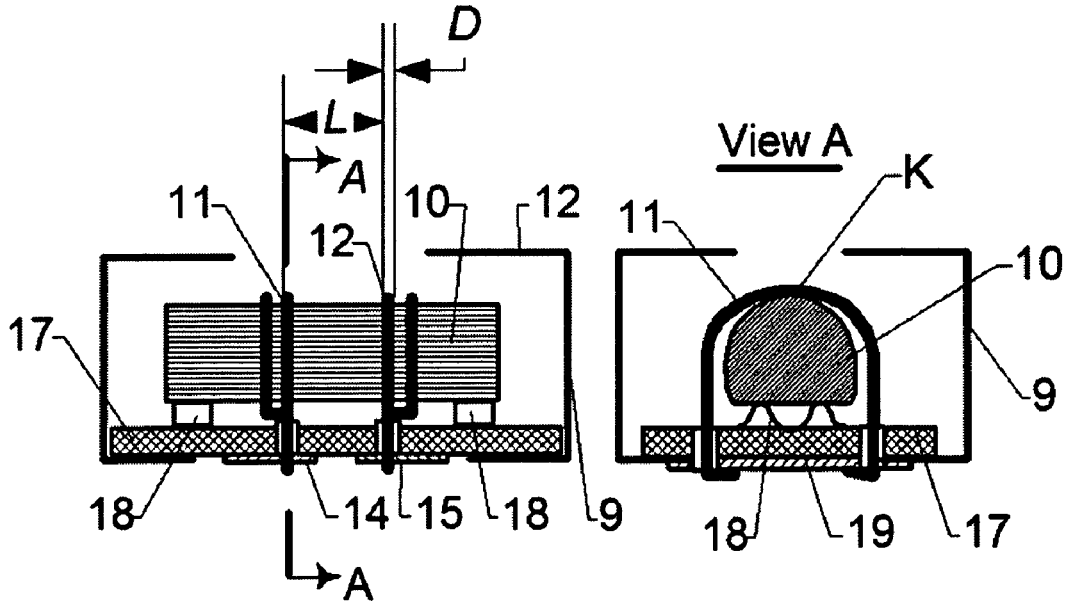
FIG. 2 is a cross-sectional view of trigger geometry of the device.
Figure 6:
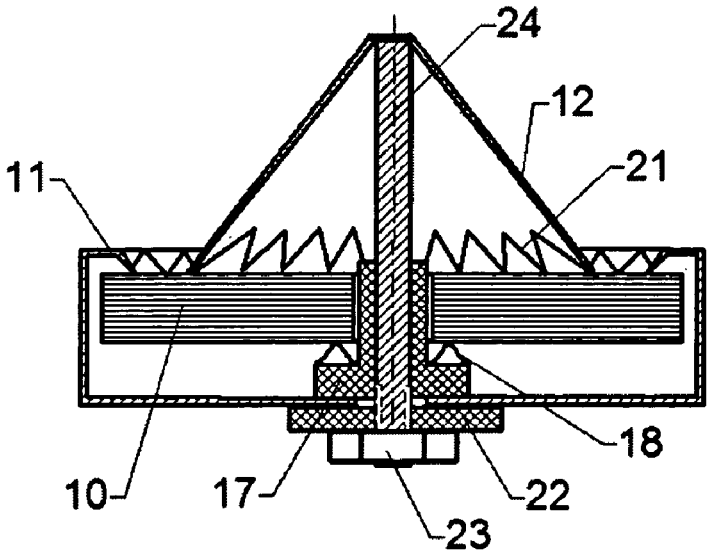
FIG. 6 is an enlarged view of the trigger geometry with conic contacting electrode.

The contacting electrode may have several embodiments. FIGS. 1 and 2 show a contact electrodes geometry in the form of coupled wire holders, providing strong-fast location of the igniter. FIG. 6 shows a trigger geometry with conic contacting electrode 12 with contact part performed as periodic toothed system 21, comprising a system of contacts with disc igniter 10 surface. Similar toothed system is utilized on a contacting electrode 11.

Both contacting electrodes 11 and 12 are fastened via ceramic washer 17 and 22 by a screw-nut 23 to the igniter via pin 24 and spring 18. With purpose to reduce overall dimension of the trigger assembly the electrode 11 can have simplified geometry in the form of flat washer, clasped via ceramic 17 to the side of the igniter opposing to the electrode 12, and between the contact electrode and the igniter a graphite layer just like in case of FIG. 5 can be used. The distance between the contacting electrodes 11 and 12 is L=1-5 mm (FIG. 2).

The igniter 10 leans on ceramic insulator 17 via flat springs 18. In order to provide stable timing characteristics of the device it is necessary to place a point of contact with electrodes 11, 12 on an upper portion of the igniter, close to injection space as shown in FIG. 2 (point K) in the vicinity of base portion of the cathode (between beams of the "vapors" in FIG. 3).

Figure 4:
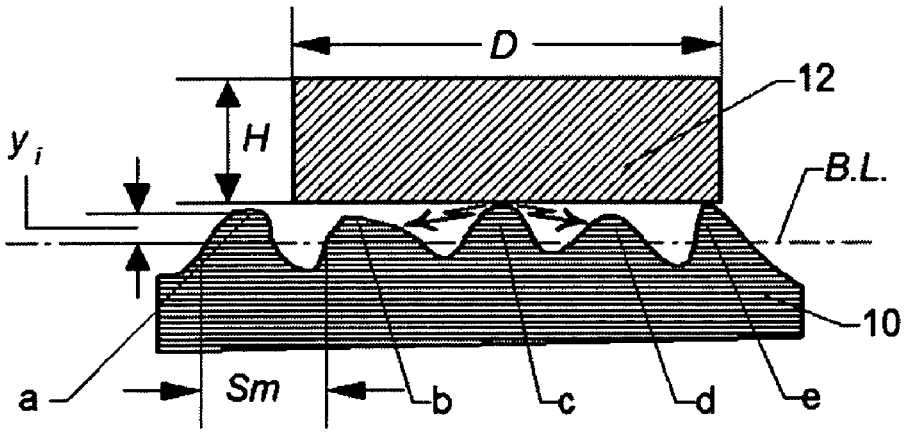
FIG. 4 shows a place of contact of the igniter with the contacting electrode.

The igniter 10 is made of polycrystal material on base of a semiconductor whose energy gap is larger than 1.5 eV. This value of band-gap is characteristic for high-temperature semiconductors like silicon carbide, boron nitride etc. At the expense of polycrystallic structure the igniter has rather rough surface with plurality of spikes c and e (FIG. 4). The spikes have relatively small average step and deviation of profile by height $y_i$ from a base line (B.L.). The value D/Sm is a criteria of contact transparency, where D—a cross-sectional width of contact electrode in the point of contact with the igniter, i.e. the dimension parallel to base line (B.L.) of the igniter. The contact electrode is clasped to the igniter surface and has electrical contact with it via spikes c and e, comprising a certain amount of contact points with contacting electrodes 11 and 12 each one with its own transient resistance.

In principle discharge triggering can be accomplished on smooth surface as well. However the existence of spikes on the igniter surface and the contacting electrodes improves the device characteristics. Depending on the igniter material characteristic voltage the electrodes can be located at the distance 1-5 mm from each other. At that the prescribed width of contacting electrode must not exceed the average pitch of roughness value on the igniter surface more than in 100 times (D/Sm<100). Higher limiting values are allowed for round or knife-type contacting electrodes, lower—for square electrodes.

The igniter may have non-linear characteristic.

Non-linear voltage-current characteristic (VCC) of the igniter can be achieved provided that the igniter is fabricated of a semiconductor compounds crystals conglomerate, e.g. silicon carbide (boron carbides, boron and aluminum nitrides, zinc oxide and other high-temperature semiconductors can be utilized). However the aforesaid conglomerates, even being baked at very high temperatures, will be unstable and extremely sensitive to jolting, impacts and can easily change their characteristics. That is why the grains of semiconductor compositions must be bound by a sticker. In this case the igniter material is fabricated in the form of semiconductor compositions utilizing ceramic technology methods, thereby a powder of basic semiconductor material with interstice dilled with a semiconductor or a dielectric compound (e.g. sodium silicate). At that in order to simplify triggering circuits the materials must have threshold (characteristic) voltage not greater than 5 kV.

Trigger geometry can comprise internal contacting electrode 11 (FIG. 5), located at the distance L from the point of contact K CE 12 with the igniter. In this case the distance L is counted off not by the surface as in FIG. 2, but by the igniter volume. The distinction is also that between the electrode 12 and the igniter internal surface a graphite layer 20 can be used to reduce transient resistance of internal contact. It is made to provide sparking on the igniter external surface only. Introduction of the internal contacting electrode allows to increase in principle a quantity of contact points on the surface (e.g. bridging external contact electrodes 12), distribute them along the full length of the igniter, thereby increasing a service time of trigger assembly.

Figure 5:
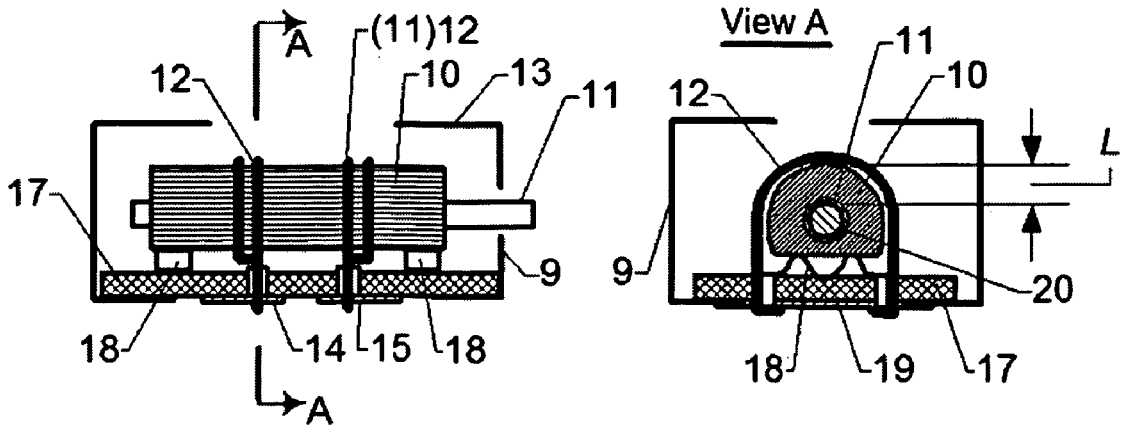
FIG. 5 is an enlarged view of the trigger geometry with internal contacting electrode.

It is worth noting that further increase of the contacting electrodes quantity (over 4-5) does not improve effectiveness of the trigger geometry as for construction in FIG. 1 this will lead to reinforcement of a contact surfaces screening, whereas for construction in FIG. 5 this will lead to increase in transfer capacitance, bridging trigger circuit.

The switch is filled with hydrogen or deuterium at the pressure of 0.1-0.6 millimeters of mercury to provide high hold-off voltage on the left hand brand branch of the Paschen curve.

During use of the device one of the contacting electrodes is connected to the cathode (either directly or, in order to reduce discharge development time, via resistor 10-100 Ohm or inductivity not larger than 1 μH) while another—with trigger circuit. When applying to the electrode a negative (in respect to the cathode potential) voltage pulse exceeding a threshold value (characteristic voltage accepted for description of varistor-type semiconductor material), the igniter resistance declines sharply and a major part of energy is evolved in one of the contact points as a sparkle. If trigger energy and charged particles emission density are high enough, the sparkle plasma initiates a development of a discharge, overlapping gas distance between electrodes 11 and 12 (having negative potential) that afterwards due to emerging potential difference is spread to the base part of the cathode 2 (FIG. 1). A resistor in a circuit between the cathode and the contacting electrode assures acceleration of this process owing to the fact that due to the passing the trigger current a potential of contact electrode sharply drops below cathode value leading to acceleration of discharge transfer to the cathode (into an injection area). Appropriate tests show that such a configuration assures current rise of 120 kA within 50 ns, i.e. current rise rates exceeding $2 \cdot 10^{12}$ A/s. A trigger electrode 9 (FIG. 2) having upper screen 13 with a hole promotes plasma beam focusing in the direction of injection area 6 (FIG. 1) and stabilizes the beam position in respect to the switch axis, assuring low time jitter and delay time. Electrons from plasma beam are injected through cathode holes 7 into a gap between cathode 2 and anode 3 of the device thus initiating a main discharge.

The condition of maximum transparency of electrode contact points with an igniter must be fulfilled for electrical field of cathode base. As shown in FIG. 4 when a contact electrode 12 is connected with the igniter 10 in medium part of the electrode (lug c) at a level D/Sm>3 (Sm is the average pitch of roughness value on the igniter surface) the output of charged particles from a spark plasma into a trigger electrode cavity and into an injection space is hampered in comparison with a place of contact on the edge of electrode. Under natural conditions the plasma injection depends on energy dissipated during micro-explosions (sparks). At that due to a sharp rise of the spark internal pressure the plasma can rapidly jump out off a narrow slit between the contacting electrode and the igniter, which somehow reduces shielding effect. This allows to sufficiently increase D/Sm, which is important for simplification of the trigger part assembling process.

It is worth noting that the specified levels of D/Sm are selected from experimental data, higher values relate to the case of higher quality of surface processing (low roughness), e.g. for polished up to Ra=1.6 μm (profile $y_i$ normal deviation according to RF standard ГОСТ25142-82).

However the use of materials with low roughness (at Sm less than 1.6 μm obtained by buffing) is inexpedient on one part due to economical reasons, on another part due to necessity to reduce the dimension D of the contacting electrode in order to provide contact transparency (D/Sm<100), which leads to reduction of the electrode mass and quick failure of the device due to erosion within service time.

For values of D/Sm over 100 at the beginning of service time the operation of the device can be rather stable (without misfire of the main discharge), but as the contacting electrodes and the igniter are being used, the places of contact go deep down into the electrodes center. In this case right after a spark appears that is for formally good function of a trigger, due to problematic output of plasma from the contact place into a trigger electrode vicinity, reliability can be sharply reduced due to appearance of misfire in the anode part of the device. The optimal ratio for round contacting electrodes dimensions (D/H=1 over the range of D from 1 to 2 mm) and igniter surface roughness is D/Sm=10-40.

The distance between the contacting electrodes 11 and 12 is a determinative for ensuring a reliable triggering. The best choice of 1-5 mm can be explained by the following factors. The effectiveness of trigger part is maximum provided that the major portion of trigger pulse energy is dissipated in contact points, ideally in one point. If the distance exceeds 5 mm the power losses in the bulk of the semiconductor igniter grow, which requires increase of power of trigger pulse generator thus reducing effectiveness of the device. This is particularly important for the igniters with higher resistances, in particular with non-linear voltage-current characteristic. On the other hand due to the fact that spring-loaded construction is not strictly rigid but has some freeness, the distances less than 1 mm under operational conditions of the device (thermal change, vibrations, contact electrode erosion) are hard to provide due to technological reasons and in the course of operation there can be short-circuits in the contact electrodes. In the process of operation the igniter 10 and the electrodes 11 and 12 material (FIG. 3) evaporates gradually, however due to elastic properties of the spring 18 their contact remains good for a long time.

Since the electrode with a negative potential is eroded more than others during operation, the service time of the device can be prolonged by changing polarity of starting electrodes.

The discharge initiation in the anode part of the switch can be executed in two regimes: by a spark, emerging in a contact point of the igniter 10 with the electrodes 11 or 12 and by an arc, emerging between the electrode 11 and 12 and then between one of the electrodes 11 (12) having negative polarity and cathode base 2 (FIG. 1). The first mean requires less energy but has higher instability (jitter greater than 1 μs) of delay time from pulse to pulse and within service time. Whereas the arc discharge offers more stable parameters of the device within service time, but trigger voltage must be not less than 2 kV and current not less than 10 A at trigger voltage rise rate exceeding 5 kV/μs.

Unlike typical configurations the use of high-resistance semiconductor igniter having non-linear voltage-current characteristic significantly simplifies geometry by avoiding an artificial multidrop contact and using smooth contact electrodes 11 and 12. The geometry offers at least not worse than existing level of switching characteristics at higher frequency capability and significantly higher operational temperature. However due to the presence of additional element, namely the development of the contacting electrodes surface as a periodic structure with macrospikes (see for example FIG. 6) the discharge initiation energy can be reduced whereas the resource of electrode material is growing simultaneously with increase of contact transparency (screening reduction by electrodes 11 and 12).

In the semiconductor igniter with linear voltage-current characteristic (VCC) the current is distributed all over the volume that is why to provide a sufficient power of the spark, initiating the process of discharge firing, the igniter must have relatively low resistance (from some tens Ohms up to some kOhm).

Under normal thermal conditions the element requires current value exceeding 80 A, whereas at increased operational temperatures (more than 150° C.) due to significant reduction of the igniter resistance the stable operation of the device is provided only with trigger currents exceeding 150 A. That is why for such conditions the igniter with non-linear VCC is more effective.

The application of the igniter made of a polycrystal material based on a semiconductor whose energy gap is larger than 1.5 eV and specific resistance is larger than 10 kOhm/cm, especially a material with non-linear VCC, ensures improvement of several important parameters of the device:

- sharp current rise occurs only in one or at the most in some points of contact of electrodes with the igniter surface as after that the other contact points appear to be under potential which is less than characteristic value, which, preserving high energy liberation density in the contact point, allows to substantially reduce a driver power;
- non-linear (varistor) voltage-current characteristic ensures sharpening of trigger current pulse edge, more effective use of energy and reduction of delay time and time jitter;
- wide-gap semiconductor due to less dependence on temperature ensures a capacity for work at significantly higher temperatures (up to 500 ∈C and even more) and at higher pulse repetition rates;
- the igniter made of basic material with filler features higher mechanical strength and porosity less than 40%, thus promoting a process of the device pump-down.

The igniter with non-linear VCC in comparison with a linear VCC device is capable of operating at significantly higher initial resistance, that at voltage less than characteristic usually comprises from some kOhm up to some tens MOhm. The device with the described igniter was tested in the following regime—peak anode voltage from 1 to 50 kV, peak current up to 200 kA, charge transfer up to tens Coulomb. At that the delay time was 0.1-0.3 μs, time jitter was less than 5 ns, igniter service time was about 50-100 millions of shots. The firing energy for the present construction is reduced in several times in comparison with the igniter with linear VCC, at that a trigger pulse voltage can be reduced up to 0.5-1 kV, peak current value up to 10-20A. The present igniter operates effectively in a wide range of temperature (from −60 to +500° C.), ensuring stable temporal parameters.

What is claimed is:

1. A controllable gas-discharge device, comprising an anode and a hollow cathode having a cavity and a base, the hollow cathode being separated from the anode and the base of the cathode being oriented thereto, wherein said base is provided with openings embedded therein for coupling the main discharge gap to a trigger electrode which is arranged in the cathode cavity and is provided with an igniter made of a polycrystal semiconductor material, wherein the igniter is made of polycrystal material based on a semiconductor whose energy gap is larger than 1.5, the device further comprising at least two contacting electrodes connected to the igniter, wherein at least one contacting electrode is connected to the trigger electrode, whereas the other is insulated therefrom and connected to the cathode, and wherein the maximum width of the contacting electrode in the cross-section thereof across a point where it is brought into contact with the igniter is equal to or less than 100 times the average pitch of roughness value on the igniter surface.

2. The switch of claim 1 wherein said igniter is made of polycrystal material on basis of a semiconductor with non-linear voltage-current characteristic and threshold voltage not more than 5 kV.

3. The switch of claim 1 or 2 wherein said polycrystal material of the igniter consists of granules of the base semiconductor material with gaps among them, filled with a polycrystal or a dielectric binding material.

4. The switch of claim 1 or 2 wherein the distance between contacting electrodes is 1-5 mm, the points of contact with the igniter are placed on the upper part of the igniter so as to provide direct visibility of said contacts in the direction of cathode base, whereas to eliminate breakdown in other directions said igniter is placed into a focusing screen.

5. The switch of claim 1 or 2 wherein one of the contacting electrodes, namely the one connected with the cathode is placed inside said igniter.

6. The switch of claim 1 wherein it further comprises a screen, disposed in the cathode cavity between the cathode base and the trigger electrode, electrically connected to the cathode and excluding presence of direct visibility of the igniter from an anode part through the holes in the cathode base.

7. The switch of claim 1 wherein said igniter is made in the form of semiconductor compositions by means of ceramic technology with porosity not more than 40% of powders of one or some semiconductor and dielectric materials.

8. The switch of claim 1 wherein said contacting electrodes are connected to the trigger circuit via active or inductive resistive elements.

9. The switch of claim 1 wherein as a trigger electrode one of contacting electrodes is used.

* * * * *